US007885561B2

(12) United States Patent
Ohnishi et al.

(10) Patent No.: US 7,885,561 B2
(45) Date of Patent: Feb. 8, 2011

(54) ELECTRIC CHARGING DEVICE, IMAGE FORMING APPARATUS, ELECTRIC CHARGING METHOD, AND MANUFACTURING METHOD OF ELECTRIC CHARGING DEVICE

(75) Inventors: Hideki Ohnishi, Chiba (JP); Toshiaki Kagawa, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 325 days.

(21) Appl. No.: 12/213,270

(22) Filed: Jun. 17, 2008

(65) Prior Publication Data

US 2008/0317503 A1 Dec. 25, 2008

(30) Foreign Application Priority Data

Jun. 20, 2007 (JP) ..... 2007-163113

(51) Int. Cl.
*G03G 15/02* (2006.01)

(52) U.S. Cl. ..... 399/50; 399/173

(58) Field of Classification Search ..... 399/50, 399/89, 128, 129, 170, 173, 311, 315; 250/324–326; 361/212–214, 225, 229, 235
See application file for complete search history.

(56) References Cited

U.S. PATENT DOCUMENTS 5,367,366 A 11/1994 Kido et al.
7,403,735 B2 * 7/2008 Yasutomi et al. ..... 399/159
2007/0201910 A1 8/2007 Kagawa et al.
2007/0212111 A1 * 9/2007 Kagawa et al. ..... 399/168

FOREIGN PATENT DOCUMENTS

JP 1-312563 12/1989
JP 6-315652 11/1994
JP 8-160711 6/1996
JP 9-102380 A 4/1997
JP 2002-040757 2/2002

* cited by examiner

*Primary Examiner*—Robert Beatty
(74) *Attorney, Agent, or Firm*—Nixon & Vanderhye, P.C.

(57) ABSTRACT

A needle electrode having a pointed section is provided so as to face a charge-target object, and a voltage to be applied to the needle electrode is set so that $2 \leqq (E2 \cdot S2)/(E1 \cdot S1) \leqq 5$ is satisfied, where an ionization area A1 indicates an area where ionization occurs to oxygen molecules in an atmosphere; a dissociation area A2 indicates an area where dissociation occurs to the oxygen molecules in the atmosphere (excluding the ionization area A1); E1 indicates an average electric field strength in the ionization area A1; E2 indicates an average electric field strength in the dissociation area A2; S1 indicates square measure of the ionization area A1 on a plane which includes a straight line connecting the needle electrode and the charge-target object so that a distance between the needle electrode and the charge-target object becomes a shortest distance; and S1 indicates square measure of the dissociation area A2 of the plane. Thus, the electric charging device is capable of carrying out charging which (i) excels in charging uniformity, (ii) reduces products such as ozone and nitrogen oxide and (iii) stably continues for a long stretch of time.

14 Claims, 7 Drawing Sheets

ELECTRIC CHARGING DEVICE, IMAGE FORMING APPARATUS, ELECTRIC CHARGING METHOD, AND MANUFACTURING METHOD OF ELECTRIC CHARGING DEVICE

This Nonprovisional application claims priority under U.S.C. §119(a) on Patent Application No. 163113/2007 filed in Japan on Jun. 20, 2007, the entire contents of which are hereby incorporated by reference.

FIELD OF THE INVENTION

The technology disclosed relates to an electric charging device, and an electric charging method, each of which is capable of carrying out charging which (i) excels in charging uniformity, (ii) less generates products, such as ozone and nitrogen oxide, during the discharging and (iii) does not deteriorate with age. The technology disclosed herein relates also to a manufacturing method of the electric charging device and an image forming apparatus having the electric charging device.

BACKGROUND

In a typical conventional electrophotographic image forming apparatus, an electric charging device of corona discharge type is used for devices such as an electric charger which uniformly charges a photoreceptor, a transfer device, and a paper removal device. The transfer device electrostatically transfers, on a recording paper or other recording material, a toner image formed on a photoreceptor or the like. The paper removal device peels off a recording paper or other recording material which is electrostatically sticking to, for example, a photoreceptor.

A so-called scorotron, a so-called corotron or the like is used as the electric charging device of corona discharge type. The corotron includes (i) a shielding case which has an opening provided so as to face a charge-target object such as a photoreceptor and a recording paper and (ii) a sawtooth-shaped or a line-shaped discharge electrode which is provided over the inside of the shielding case. The corotron charges a charge-target object by applying a high voltage to a discharge electrode so that corona discharge is generated. The scorotron further includes a grid electrode arranged between the discharge electrode and the charge-target object, in addition to the arrangement of the corotron. The scorotron uniformly charges the charge-target object by applying a desired voltage to the grid electrode so that the amount of charged particles which pass through the grid electrode is controlled (see Patent Document 1 (Japanese Unexamined Patent Publication, Tokukaihei, No. 6-11946 (published Jan. 21, 1994))).

FIG. 9 is an explanatory drawing schematically illustrating an electric charging mechanism of a conventional electric charging device of corona discharge type. As is described above, an electric charging device of corona discharge type includes a line-shaped, a sawtooth-shaped or a needle-shaped discharge electrode 101, and a counter electrode (discharge-target object) such as a photoreceptor 102 and a grid electrode 103. The photoreceptor 102 and the like, which serves as the charge-target object, is charged in the following method: (i) an unequal electric field is generated between the discharge electrode 101 which has a small curvature radius and the counter electrode (discharge target object), by applying a high voltage between the two electrodes; and (ii) electrons are emitted (discharge due to electron avalanche) due to a local ionization effect caused by a strong electric field generated in the vicinity of the discharge electrode 101. The grid electrode 103 controls the amount of electrons emitted from the discharge electrode 101 toward the charge-target object such as the photoreceptor 102. As such, the electrons are also emitted to the grid electrode 103.

The conventional electric charging devices of the corona discharge type have the problem that products, such as ozone ($O_3$) and nitrogen oxide (NOx), are generated during the discharging. Namely, a nitrogen molecule ($N_2$) is dissociated to nitrogen atoms (N) by energy due to the emission of the electrons (collision of electrons). Each of the nitrogen atoms thus dissociated is chemically combined with an oxygen molecule ($O_2$). Thus, nitrogen oxide (nitrogen dioxide ($NO_2$)) is generated. Similarly, the oxygen molecule ($O_2$) is dissociated to oxygen atoms (O). Each of the oxygen atoms thus dissociated is chemically combined with the oxygen molecule ($O_2$). Thus, ozone ($O_3$) is generated.

If a great amount of ozone is generated, problems occur such as generation of ozone odor, harmful effects on the human body, and deterioration of components due to strong oxidation. Additionally, the generation of nitrogen oxide causes adhesion of nitrogen oxide onto the photoreceptor as ammonium salt (ammonium nitrate). This causes a problem that abnormal image is brought about.

For example, in Patent Document 2 (Japanese Unexamined Patent Publication, Tokukaihei, No. 8-160711 (published Jun. 21, 1996)), a technique for reducing the amount of ozone generated is disclosed. Patent Document 2 discloses an electric charging device including a plurality of discharge electrodes, a high voltage power source, a resistor, a grid electrode, and a grid power source. The plurality of discharge electrodes are arranged in a predetermined axis direction so as to be spaced at a substantially constant pitch. The high voltage power source is provided to apply to the discharge electrodes a voltage of not less than a break-down voltage. The resistor is provided between an output electrode of the high voltage power source and the discharge electrodes. The grid electrode is provided, close to the discharge electrodes, between the discharge electrodes and the charge-target object. The grid power source is provided to apply a grid voltage to the grid electrode. The electric charging device disclosed in Patent Document 2 reduces the amount of ozone generated by reducing the discharged current. The discharged current is reduced by having a gap, between the discharge electrodes and the grid electrode, of not more than 4 mm.

If a high voltage is continuously applied to an electrode having a projection-shaped tip section, the tip of the projection is worn away and rounded off over time. This causes an increase in amount of ozone generated, due to a decrease in discharge rate. In view of this, Patent Document 3 (Japanese Unexamined Patent Publication, Tokukaihei, No. 6-315652 (published Nov. 15, 1994)) replaces one electrode with another electrode prepared in advance, when an amount of ozone generated meets a certain condition.

Although the technique of Patent Document 2 could reduce the amount of ozone generated by reducing the discharge current, the reduction amount of ozone is insufficient, and ozone of an amount of around 1.0 ppm is still generated.

Additionally, the technique of Patent Document 2 has a problem that the discharge becomes unstable due to (i) adhering of products generated during the charging, toner, paper powder and the like to the electrode and/or (ii) wearing and deteriorating of the tip of the electrode caused by the discharge energy.

The technique in Patent Document 3 suppresses the amount of ozone generated to below a certain amount by replacing one electrode with another when the amount of ozone generated meets a certain condition. However, the technique requires two or more pairs of electrodes, a mechanism for replacing the electrodes, an ozone detection sensor, and the like. This causes the device to become large in size, and causes an increase in cost for manufacturing the device.

SUMMARY

The technology disclosed herein is made in view of the conventional problems, and its object is to provide an electric charging device and an electric charging method, each of which is capable of carrying out charging which (i) excels in charging uniformity, (ii) reduces products such as ozone and nitrogen oxide and (iii) stably continues for a long stretch of time. Another object of the technology disclosed herein is to provide a manufacturing method of the electric charging device and an image forming apparatus having the electric charging device.

In order to attain the objects, an electric charging device of the technology disclosed herein includes: at least one charging electrode to be provided in non-contact with a charge-target object, and voltage application means for applying a voltage to said at least one charging electrode, the electric charging device causing the charge-target object to be charged by ions generated when a voltage is applied to said at least one charging electrode, said at least one charging electrode having a pointed section provided so as to face the charge-target object; and the voltage to be applied to the electric charging device is set so as to satisfy $2 \leqq (E2 \cdot S2)/(E1 \cdot S1) \leqq 5$, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section of the ionization area A1 on a plane which includes a straight line connecting said at least one charging electrode and the charge-target object so that a distance between said at least one charging electrode and the charge-target object becomes a shortest distance; and S2 indicates cross-section of the dissociation area A2 of the plane.

In order to attain the objects, a charging method for the electric charging device of the technology disclosed herein is a method for causing a charge-target object to be charged by ions generated when a voltage is applied to at least one charging electrode, said method comprising the steps of: preparing and using as said at least one charging electrode an electrode having a pointed section provided so as to face the charge-target object; and setting the voltage to applied to said at least one charging electrode so that $2 \leqq (E2 \cdot S2)/(E1 \cdot S1) \leqq 5$ is satisfied, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section the ionization area A1 on a plane which includes a straight line connecting said at least one charging electrode and the charge-target object so that a distance between said at least one charging electrode and the charge-target object becomes a shortest distance; and S2 indicates cross section of the dissociation area A2 of the plane.

In order to attain the objects, a manufacturing method for the electric charging device of the technology disclosed herein is a method for manufacturing an electric charging device which includes at least one charging electrode to be provided in non-contact with a charge-target object; and voltage application means for applying a voltage to said at least one charging electrode, the electric charging device causing the charge-target object to be charged by ions generated when a voltage is applied to said at least one charging electrode, said method comprising the steps of: providing said at least one charging electrode having a pointed section so as to face the charge-target object; and setting the voltage to be applied to said at least one charging electrode so that $2 \leqq (E2 \cdot S2)/(E1 \cdot S1) \leqq 5$ is satisfied, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section of the ionization area A1 on a plane which includes a straight line connecting said at least one charging electrode and the charge-target object so that a distance between said at least one charging electrode and the charge-target object becomes a shortest distance; and S2 indicates cross section of the dissociation area A2 of the plane.

With each of the arrangements, the charge-target object is charged by the ions. Therefore, it is possible to charge a charge-target object more uniformly, as compared to a case where a charge-target object is charged by electric discharge. Use of a charging electrode having a pointed section allows a decrease in $(E2 \cdot S2)/(E1 \cdot S1)$ ratio. An adjustment of a voltage to be applied to the charging electrode enables an inequality $2 \leqq (E2 \cdot S2)/(E1 \cdot S1) \leqq 5$ to be satisfied. The dissociation area with respect to the ionization area can be made to be smaller by setting the $(E2 \cdot S2)/(E1 \cdot S1)$ ratio to not more than 5, as compared to a case where the $(E2 \cdot S2)/(E1 \cdot S1)$ ratio is greater than 5. It is thus possible to reduce the ratio of the generated amount of ozone, nitrogen oxide and the like with respect to the generated amount of ions. As such, it is possible to efficiently generate an amount of ions required to uniformly charge the charge-target object, while reducing the generated amount of ozone, nitrogen oxide and the like being generated. When setting the (E2·S2)/(E1·S1) ratio to not less than 2, it is avoided that the voltage to be applied to the charging electrode becomes too great. This suppresses an increase in wearing speed (deterioration speed) of the charging electrode. Therefore, it is possible to stably carry out electric charging over the long term.

Additional objects, features, and strengths of the technology disclosed herein will be made clear by the description below. Further, the advantages of the technology disclosed herein will be evident from the following explanation in reference to the drawings.

DESCRIPTION OF THE EMBODIMENTS

Figure 2:
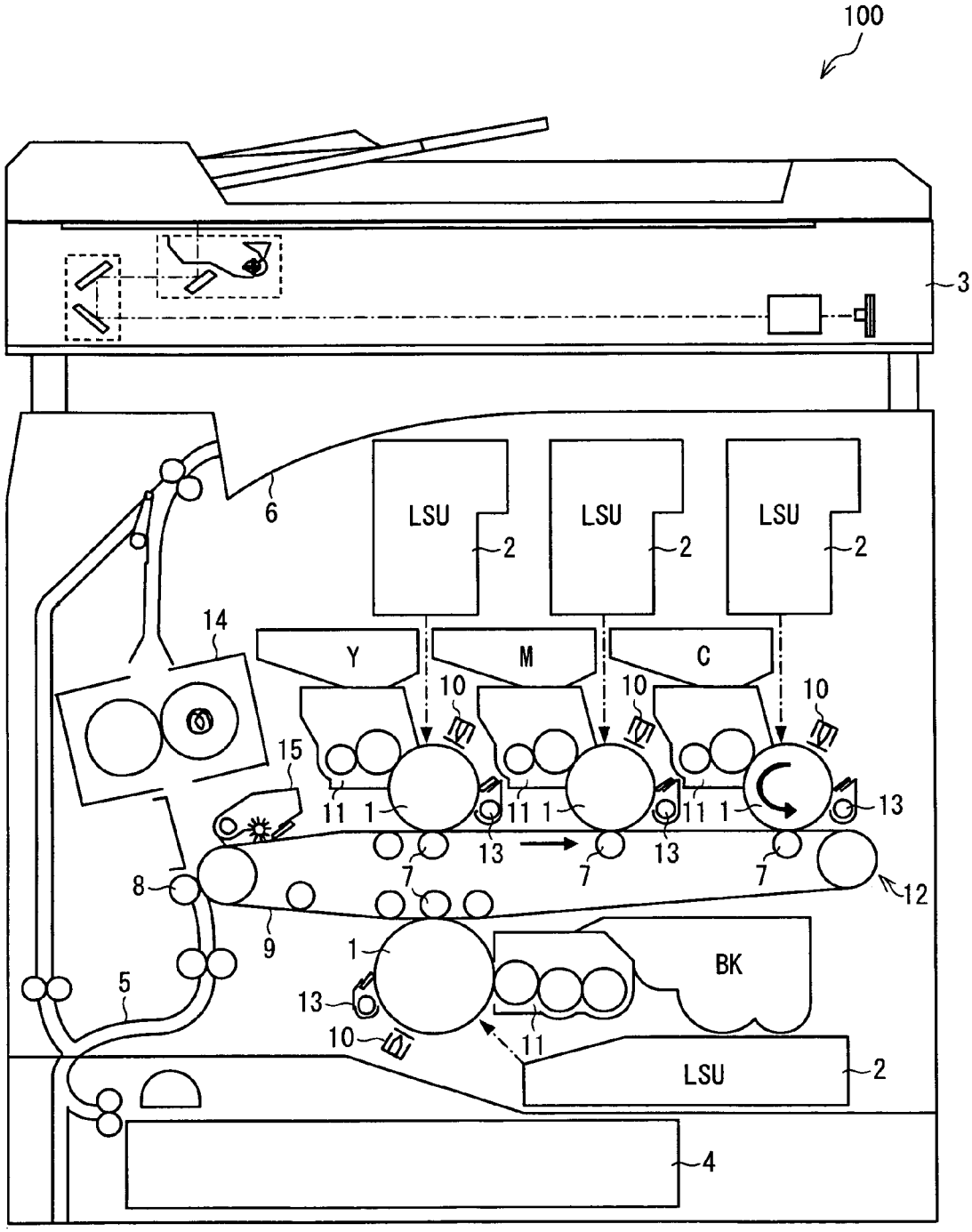
FIG. 2 is a cross sectional view illustrating an image forming apparatus which includes an electric charging device in accordance with one embodiment of the technology disclosed herein.

The following description explains one embodiment of the technology disclosed herein. FIG. 2 is a cross sectional view illustrating a schematic structure of a copying machine (image forming apparatus) 100 which includes an electric charging device 10 in accordance with the technology disclosed herein. The copying machine 100 is a so-called electrophotographic image forming apparatus, in which printing is performed by carrying out: (i) a first transfer process in which toner adhered to an electrostatic latent image formed on a photoreceptor drum is transferred to an intermediate transfer belt for each of four colors, and (ii) a second transfer process in which toner images of the four colors which are overlapped on the intermediate transfer belt are in a lump transferred to a recording paper.

The copying machine 100 includes photoreceptor drums (image bearing member) 1, electric charging devices 10, laser writing units (LSU) 2, developing devices 11, a transfer device 12, cleaning devices 13, charge removing devices (not illustrated), a fixing device 14, a belt cleaning device 15, an image reading unit 3, a paper feeding unit 4 which supplies recording paper, feed means 5 for feeding a recording paper, a discharge tray 6, as illustrated in FIG. 2. The electric charging devices 10, the laser writing units 2, the developing devices 11, the cleaning devices 13 and the charge removing devices are provided around the photoreceptor drums 1. The photoreceptor drums 1, the electric charging devices 10, the laser writing units 2, the developing devices 11, the cleaning devices 13 and the charge removing devices are provided for each of colors, i.e., cyan (C), magenta (M), yellow (Y) and black (B).

Each of the electric charging devices (main electric charging device) 10 charges a surface of a corresponding photoreceptor drum (charge-target object) 1 so that the surface has a predetermined potential. In the present embodiment, each of the photoreceptor drums 1 is charged by ions emitted from a respective one of the electric charging devices 10. Details of the electric charging devices 10 are later described.

Each of the laser writing units 2 irradiates (exposes) laser light to a respective one of the photoreceptor drums 1 based on image data read by the image reading unit 3 or image data received from an external device so that the surface of the photoreceptor drum 1 which is uniformly charged is irradiated and scanned by a light image. This causes an electrostatic latent image based on the image data to be written onto the photoreceptor drum 1.

A respective one of the developing devices 11 supplies toner to the electrostatic latent image formed on the surface of the photoreceptor drum 1. This causes the electrostatic latent image to be visualized, thereby forming a toner image on the photoreceptor drum 1.

The transfer device 12 includes an intermediate transfer belt 9, primary transfer rollers 7, and a secondary transfer roller 8. The intermediate transfer belt 9 runs over a plurality of rollers. The primary transfer rollers 7 are provided so as to face the photoreceptor drums 1 for respective colors, respectively, via the intermediate transfer belt 9. The secondary transfer roller 8 is provided so as to face one of the plurality of rollers over which the intermediate transfer belt 9 runs, via the intermediate transfer belt 9. The present embodiment deals with a case where the toner images of yellow, magenta, cyan and black are transferred to be overlapped in this order on the intermediate transfer belt 9. The present embodiment, however, is not limited to this.

Each of the cleaning devices 13 removes and collects toner, remained after the transfer, on a respective one of the photoreceptor drums 1. This allows new toner images to be formed on the photoreceptor drums 1. After the toner is removed by each of the cleaning devices 13, the electric charge on the surface of each of the photoreceptor drums 1 is removed by a respective one of the charge removing devices.

The belt cleaning device 15 removes and collects toner, remained after the transfer, on the intermediate transfer belt 9. This allows a new toner image to be recorded on the intermediate transfer belt 9. After the toner is removed by the belt cleaning device 15, the electric charge on the intermediate transfer belt 9 is removed by the charge removing device (not illustrated).

The fixing device 14 fixes the toner image transferred to the recording paper by applying heat and pressure.

The copying machine 100 having the arrangement carries out a printing operation as follows.

First, an image of an original document (not illustrated) is read by the image reading unit 3. Each of the photoreceptor drums 1 is rotated in a direction indicated by an arrow illustrated in FIG. 2 at a predetermined speed (at a speed of 124 mm/s in the present embodiment), while the surface of the photoreceptor drum 1 is charged by a respective one of the electric charging devices 10 so that the surface has a predetermined potential.

Next, the surface of the photoreceptor drum 1 is exposed by the respective one of the laser writing units 2 in accordance with image data of the original document read by the image reading unit 3. This causes an electrostatic latent image, which is in accordance with the image data, to be written on the surface of the photoreceptor drum 1.

Then, a respective one of the developing devices 11 supplies toner to the electrostatic latent image formed on the photoreceptor drum 1. This causes toner to adhere to the electrostatic latent image, thereby forming a toner image. Thereafter, a voltage is applied between the photoreceptor drum 1 and a respective one of the primary transfer rollers 7 of the transfer device 12. This causes the toner image on the photoreceptor drum 1 to be transferred onto the intermediate transfer belt 9. The forming of the toner image on the photoreceptor drum 1 and the transfer of the toner image from the photoreceptor drum 1 to the intermediate transfer belt 9 are carried out for each of the yellow, magenta, cyan and black colors. This causes the toner images of the four colors to overlap with each other on the intermediate transfer belt 9.

When the recording paper is sandwiched between the intermediate transfer belt 9 and the secondary transfer roller 8, the toner images on the intermediate transfer belt 9 are transferred (electrostatically transferred) onto the recording paper. The recording paper is fed from the paper feeding unit 4, via the feed means 5.

Thereafter, the fixing of toner is carried out with respect to the recording paper by the fixing device 14. After this, the recording paper is discharged to the discharge tray 6.

After the transfer, the toner remaining on the photoreceptor drum 1 is removed and collected by the cleaning device 13. After the remaining toner is removed, the electric charge is removed from the surface of the photoreceptor drum 1 by the charge removing device. Similarly, after the transfer, the remaining toner on the intermediate transfer belt 9 is removed and collected by the belt cleaning device 15. After the remaining toner is removed, the electric charge is removed from the surface of the intermediate transfer belt 9 by the charge removing device.

Figure 3:
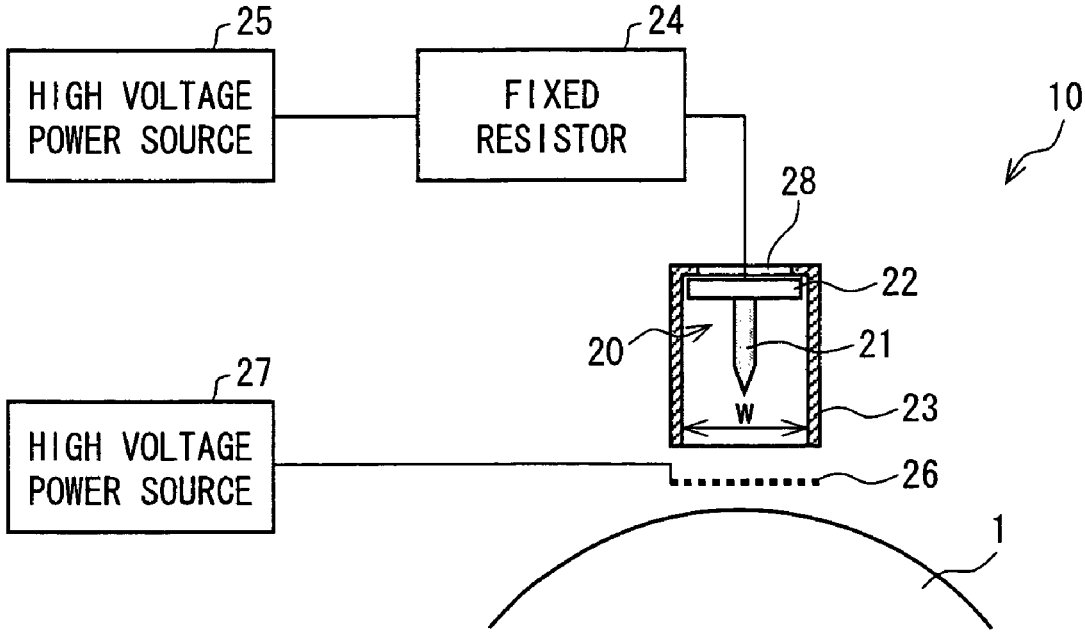
FIG. 3 is a side view of an electric charging device in accordance with one embodiment of the technology disclosed herein.
Figure 4:
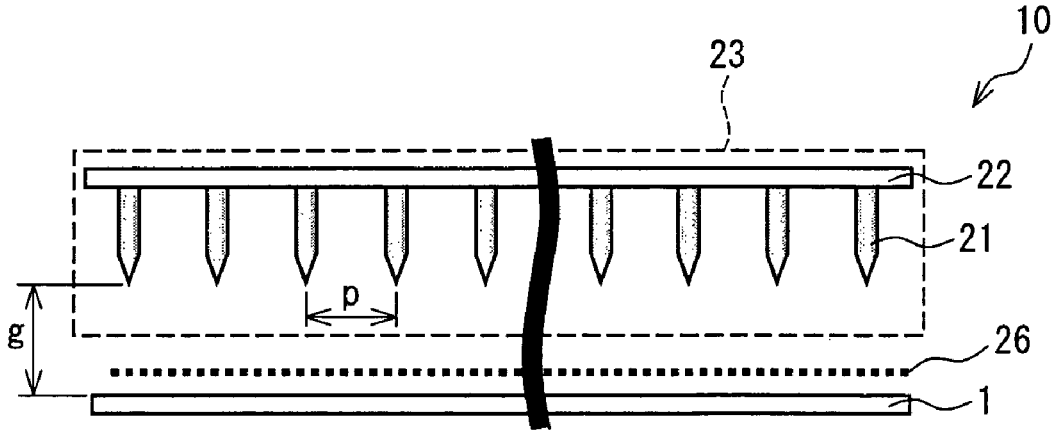
FIG. 4 is a front view of an electric charging device in accordance with one embodiment of the technology disclosed herein.

The following description explains in detail how the electric charging device 10 is arranged. FIG. 3 is a side view of the electric charging device 10. FIG. 4 is a front view of the electric charging device 10.

The electric charging device 10 includes a negative ion generation element 20, a shielding case (ion diffusion preventing member) 23, a fixed resistor (electric resistor) 24, a high voltage power source (voltage application means) 25, a grid electrode (control electrode) 26, and a high voltage power source (control voltage application means) 27, as illustrated in FIG. 3.

The negative ion generation element 20 is arranged so that a plurality of (32 in the present embodiment) needle electrodes (charging electrodes) 21 are provided on a base frame 22 made of metal (stainless steel in the present embodiment) so as to have a predetermined pitch p (10 mm in the present embodiment). Each of the needle electrodes 21 has a needlepoint pointing toward the photoreceptor drum 1 (toward an opening of the shielding case 23). The needle electrodes 21 are charging electrodes of a needle-shape. In the present embodiment, a needle made of stainless steel, such as SUS304, having a diameter of 1 mm, whose needlepoint has a curvature radius of 15 μm, is used for each of the needle electrodes 21. However, in the present embodiment, the structure of the needle electrode 21 is not limited to this, provided that a structure meets conditions (later described).

The negative ion generation element 20 is provided close to the photoreceptor drum 1 so that a gap g between respective needlepoint of the needle electrodes 21 and the photoreceptor drum 1 satisfies g=10 mm.

A negative terminal of the high voltage power source 25 is connected to the base frame 22, via the fixed resistor 24 having a resistance of 200 MΩ. This causes a predetermined voltage to be applied to the needle electrodes 21 provided on the base frame 22. With the arrangement, a predetermined direct-current voltage is applied to the negative ion generation element 20 by the high voltage power source 25. This generates the negative ions. The negative ions thus generated charge the photoreceptor drum 1 so that the photoreceptor drum 1 has a predetermined potential (a potential of −600 V in the present embodiment).

During forming of an image, a voltage corresponding to a difference between a potential of Va (Va<0) and an earth potential (Va=−6.5 kV in the present embodiment) is applied by the high voltage power source 25. Note in the present specification that "a voltage" indicates an absolute value of a potential difference. Therefore, the voltage applied by the high voltage power source 25 is |Va|=6.5 kV in the present embodiment.

The grid electrode 26 is made of stainless steel having a thickness of 0.1 mm, and is provided so as to be away, by a distance of 1.5 mm, from the photoreceptor drum 1. The grid electrode 26 is connected to a negative terminal of the high voltage power source 27. A predetermined direct-current voltage (a voltage corresponding to a difference between a potential of Vg (Vg<0) and the earth potential) is applied to the grid electrode 26 (Vg=−900 V in the present embodiment) by the high voltage power source 27.

The shielding case 23, whose cross section is like a U-shape, is provided so as to surround the negative ion generation element 20. The shielding case 23 has an opening on a first side where the grid electrode 26 is provided (the opening has a width w of 26 mm in the present embodiment), and has an air inlet 28 on a second side opposite to the first side. The shielding case 23 is made of resin or other electrically insulating or high-resistant material (material having a resistance causing no corona discharge to occur in the charging electrode 21).

The shielding case 23 causes the diffusion of the negative ions generated by the negative ion generation element 20 to be suppressed and to be directed toward the grid electrode 26.

This allows an improvement in efficiency of utilization of the ions. For example, even in a case where the gap satisfies g≧25 mm, at least 50% of an amount (density) of the negative ions is secured, such an amount (density) being obtained when the gap g is 5 mm. The shielding case 23 also allows suppression of occurrence of a situation where members around the electric charging device 10 are unnecessarily charged.

As is described above, the shielding case 23 is electrically insulated or has a high resistance. As such, it is possible to avoid that the corona discharge occurs in the shielding case 23, even in a case where a space between the negative ion generating element 20 and the shielding case 23 is small. The shielding case 23 is electrically in a floating state. However, in a case where electric charge is accumulated in the shielding case 23 and the ion generation efficiency is decreased, the shielding case 23 may be connected to the earth so that the electric charge thus accumulated is released.

Figure 5:
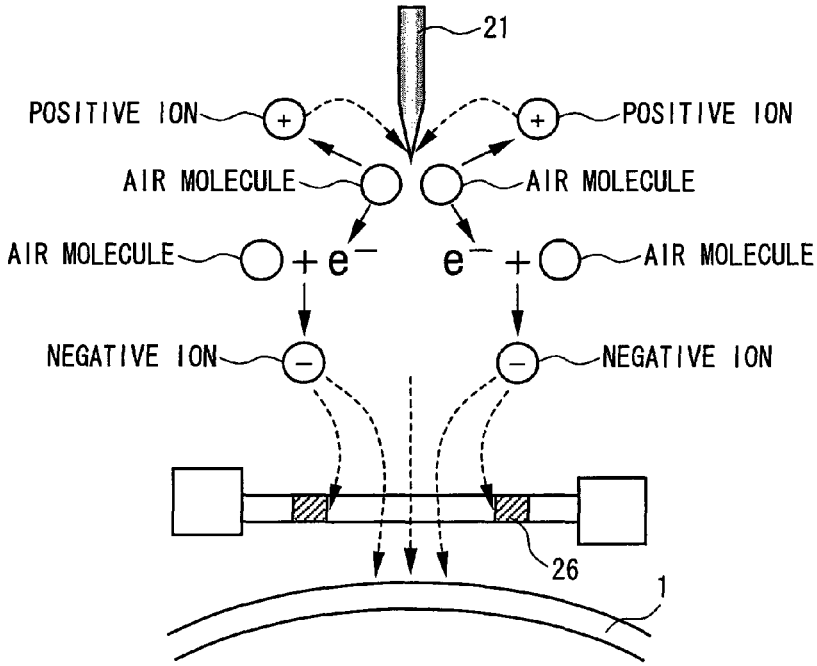
FIG. 5 is an explanatory drawing schematically illustrating a charging mechanism of an electric charging device in accordance with one embodiment of the technology disclosed herein.

The following description explains a charging mechanism of the electric charging device 10 using the negative ions. FIG. 5 is an explanatory drawing illustrating a charging mechanism of the electric charging device 10.

When a high voltage is applied to the needle electrodes 21, an extremely strong electric field is generated in the vicinity of the needlepoint section of the needle electrodes 21. This is because the needlepoint of the needle electrodes 21 has an extremely small curvature radius. However, when compared to a conventional electric charging device of corona discharge type, the gap g is greater between the needle electrodes 21 and the photoreceptor drum 1 which is a charge-target object (an object to be charged). Therefore, an electric field strength is small between the needle electrodes 21 and the photoreceptor drum 1. Consequently, this does not give rise to a situation in which electrons are emitted and directed towards the photoreceptor drum 1 (therefore, no corona discharge occurs). However, molecules in the air (e.g. oxygen molecules, nitrogen molecules, carbon dioxide molecules) are ionized to positive ions and electrons, due to the strong electric field formed in the vicinity of the needlepoint of the needle electrodes 21. Additionally, the ionized electrons join to the molecules in the air, and the molecules have negative ions. Some positive ions transfer their electric charge to the needle electrodes 21. This causes those positive ions to return to molecules. Some positive ions return to ground.

The negative ions thus generated are emitted toward the photoreceptor drum 1 along electric flux lines formed between the needlepoint of the needle electrodes 21 and respective of the grid electrode 26 and the photoreceptor drum 1. Note however that the electric field thus formed is weak as compared to a conventional electric charging device of corona discharge type. Therefore, not all the ions thus generated are emitted toward the photoreceptor drum 1 but some ions diffuse in a different direction, not toward the photoreceptor drum 1. The photoreceptor drum 1 is thus charged so as to have a predetermined potential, by the negative ions which reach the surface of the photoreceptor drum 1.

When the grid electrode 26 is provided, excess negative ions are trapped by the grid electrode 26 and electric charge (electrons) are transferred to the grid electrode 26 in a part of the photoreceptor drum 1 in which part the surface potential of the photoreceptor drum 1 has dropped (charged) due to the negative ions. As such, the surface potential of the photoreceptor drum 1 is controlled so as to have a substantially constant potential.

The following description explains the condition to be satisfied by the needle electrodes 21.

A threshold value (ionization occurrence threshold value) TH1 of electric field strength which causes the oxygen molecules in the air to be ionized is 3 MV/m. That is to say, when an electric field of not less than 3 MV/m is applied to the oxygen molecules in the atmosphere, ionization occurs, thereby ions are generated ($O_2+e \rightarrow O^{2+}+2e$). Note that "ionization" indicates separation of electron(s) from a molecule, an atom, an ion or the like. In the present embodiment, oxygen molecules in the atmosphere are caused to be ionized, thereby obtaining electrons and ions. By causing the electrons and the ions to reach a charge-target object, the charge-target object is charged.

A threshold value (dissociation occurrence threshold value) TH2 of electric field strength which causes oxygen molecules in the atmosphere to be dissociated is 1.25 MV/m. That is to say, when an electric field of not less than 1.25 MV/m is applied to the oxygen molecules in the atmosphere, dissociation occurs ($O_2+e \rightarrow 2O+e$). Note that "dissociation" indicates separation of molecules, ions and the like into further small molecules, atoms, ions and the like, respectively. When the electric field strength is not less than 3 MV/m, not only the ionization but also the dissociation of the oxygen molecules may occur. However, the ionization occurs overwhelmingly higher than the dissociation occurs. Therefore, for convenience, the following description deals with cases where an electric field strength of not less than 3 MV/m causes the ionization to occur but no dissociation to occur.

When oxygen molecules $O_2$ in the atmosphere are dissociated to oxygen atoms O, the oxygen atoms thus dissociated join to the oxygen molecules, thereby generating ozone $O_3$ ($O_2+O+M \rightarrow O_3+M$ (M is a third material object)). That is to say, normally, in the atmosphere, oxygen atoms exist as oxygen molecules and hardly any exist as ozone. However, when oxygen atoms are generated due to dissociation, ozone is generated. The oxygen atoms do not immediately become ozone but the more the amount of oxygen atoms is, the more the amount of ozone is generated. In view of this, an amount of ozone generated is reduced in the present embodiment by causing the dissociation to less occur (the dissociation to be suppressed) so that the oxygen atoms are generated as few as possible.

Figure 1:
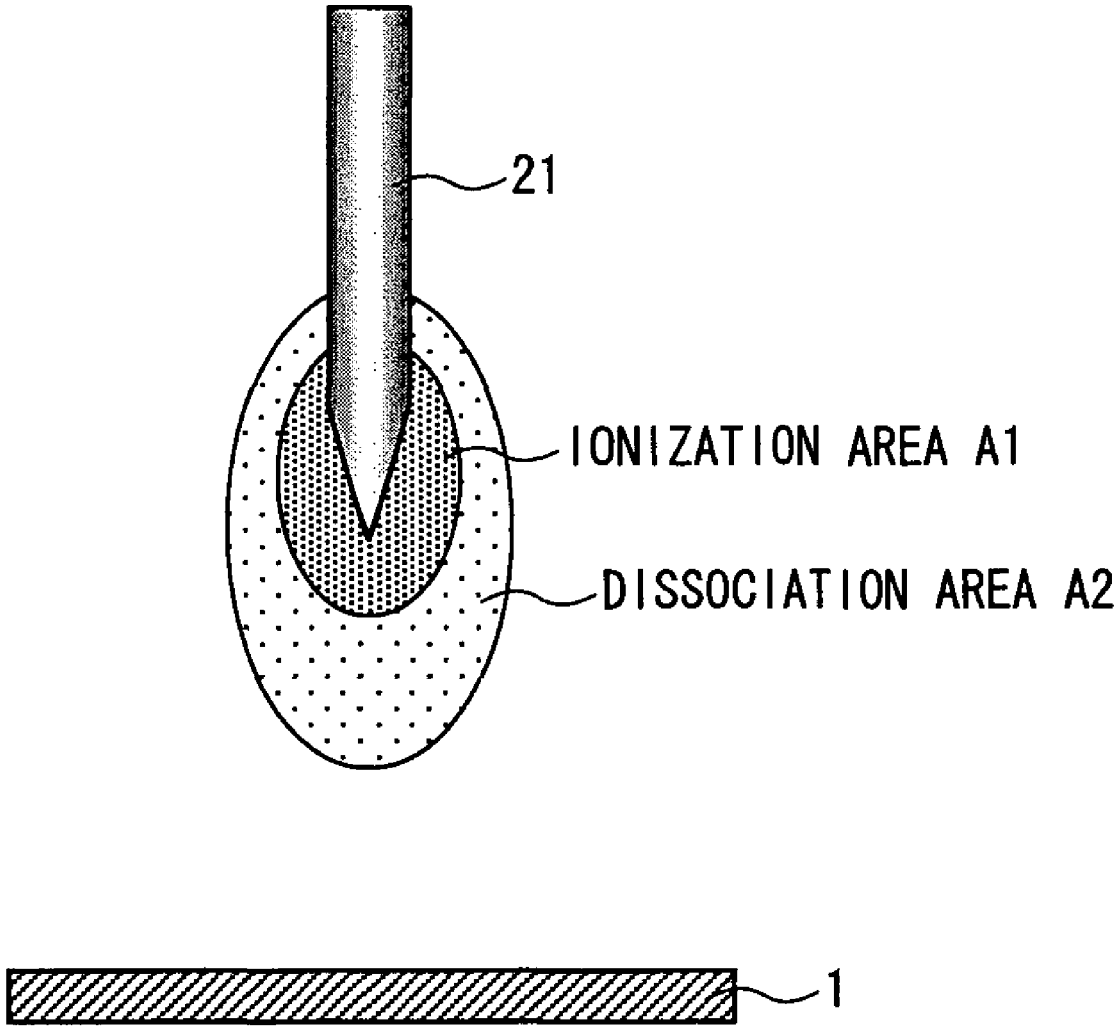
FIG. 1 is an explanatory drawing illustrating an ionization area and a dissociation area, each of which is generated on a tip of an electrode, in an electric charging device in accordance with one embodiment of the technology disclosed herein.

FIG. 1 is an explanatory drawing schematically illustrating an ionization area A1 and a dissociation area A2, each of which is generated in the vicinity of the needlepoint of the needle electrodes 21 when a voltage is applied between the needle electrodes 21 and a charge-target object 1.

As illustrated in FIG. 1, the needle electrodes 21 have a conical (pointed-shape) needlepoint. High electric field is generated intensively around the needlepoint when a voltage is applied to the needle electrodes 21. According to a distribution of the electric field strength thus generated, the closer to the needlepoint of the needle electrodes 21 an area is, the stronger the electric field strength is, in other words, the farther away from the needlepoint an area is, the weaker the electric field is. Therefore, when the predetermined direct-current voltage is applied to the needle electrodes 21, an ionization area A1 is generated in the vicinity of the needlepoint of the needle electrodes 21. In the ionization area A1, an electric field strength is not less than the ionization occurrence threshold value TH1. A dissociation area A2 is generated so as to surround the ionization area A1. In the dissociation area A2, an electric field strength is not less than the dissociation occurrence threshold value TH2 but less than the ionization occurrence threshold value TH1 (see FIG. 1).

Figure 6:
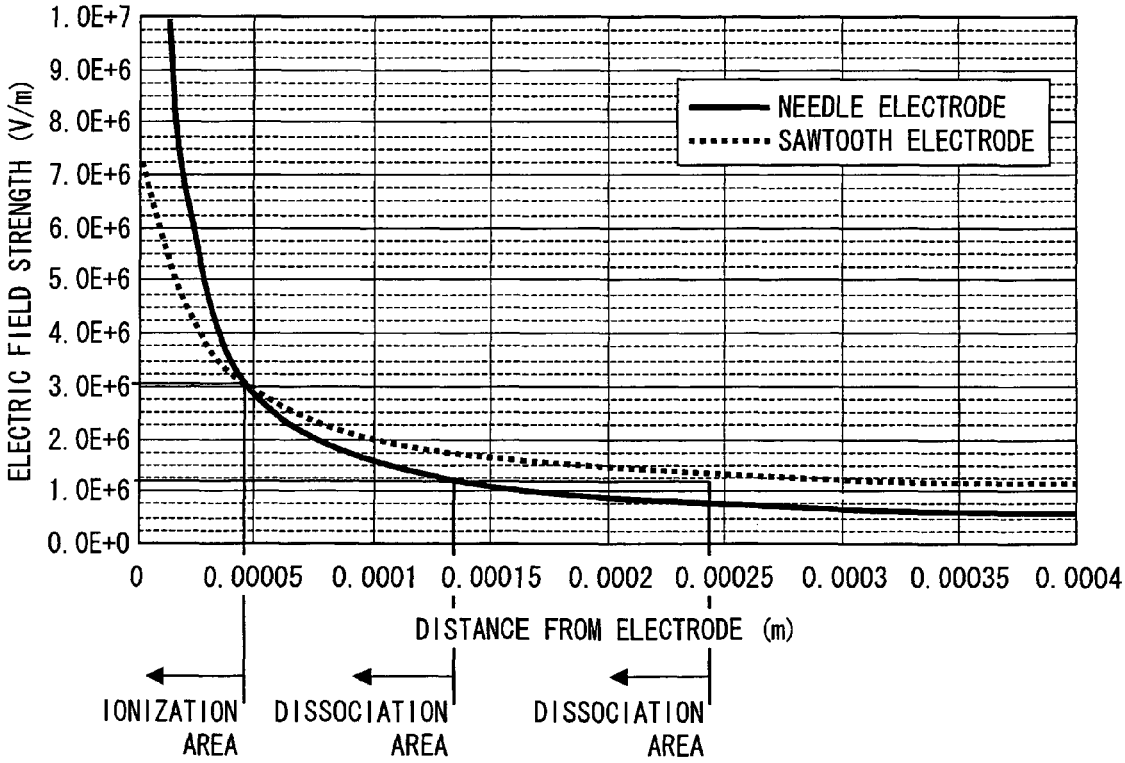
FIG. 6 is a graph illustrating a relationship between an electric field strength and a distance from a tip of an electrode in an electric charging device in accordance with one embodiment of the technology disclosed herein.

FIG. 6 is a graph illustrating a relationship between an electric field strength and a distance from the needle electrodes 21 to the charge-target object 1. The "distance from the needle electrodes 21 to the charge-target object 1" is intended to mean a shortest distance, on straight lines connecting the needle electrodes 21 with the charge-target object 1.

In FIG. 6, a needle electrode 21 is a needle electrode made of stainless steel. The needle electrode 21 has a cylindrical section having a length of 10 mm and a diameter of 1 mm. A conical needlepoint of the needle electrodes has a length of 2 mm and a curvature radius of 5 μm. FIG. 6 also illustrates data obtained in a case where a sawtooth electrode is used instead of the needle-shaped electrode. A sawtooth electrode used in this embodiment is made of stainless steel. A saw blade constituting the sawtooth has a root section having a width of 60 μm, a length of 2 mm, a thickness of 200 μm and a curvature radius of 10 μm. The sawtooth electrode is shaped so as to be pointed towards the tip. In either case of the needle-shaped electrode or the sawtooth electrode, a potential difference of −3 kV is applied between the electrode and the charge-target object, and a distance between the electrode and the charge-target object is 10 mm.

As illustrated in FIG. 6, the electric field strength decreases as the electrode farther away from the electrode in either case of the needle-shaped electrode or the sawtooth electrode. Note however that (i) the electric field strength in the vicinity of the electrode and (ii) the degree of a decrease of field strength when the distance from the electrode increases, differ depending on the shape of the electrode. More specifically, in the case of the needle-shaped electrode, the electric field strength is extremely strong in the vicinity of the electrode, as compared to the sawtooth electrode, and the electric field strength rapidly decreases as the distance from the electrode increases. On the other hand, in the sawtooth electrode, the electric field strength is weak in the vicinity of the electrode, as compared to the needle-shaped electrode, and the electric field strength slowly decreases as the distance from the electrode increases.

Therefore, as illustrated in FIG. 6, even in a case where an ionization area (an area where the electric field strength is not less than 3 MV/m (distance from the electrode)) of the needle electrode and that of the sawtooth electrode are identical to each other, a dissociation area (an area where the electric field strength is not less than 1.25 MV/m but less than 3 MV/m) of the needle electrode is narrower than that of the sawtooth electrode. It follows that the amount of ions generated by the sawtooth electrode is substantially the same as that by the needle electrode since the ionization areas of the sawtooth electrode and the needle electrode are identical to each other whereas the amount of ozone generated by the sawtooth electrode is different from that by the needle electrode (the sawtooth electrode generates more ozone than the needle electrode). Therefore, when using an electrode having a shape which causes the electric field strength to rapidly decreases as a distance from the electrode increases, it becomes possible to (i) charge a charge-target object by generating a sufficient amount of ions and (ii) reduce an amount of ozone generated.

In the present embodiment, an E2·S2/E1·S1 ratio is used for an evaluation of a degree to which the electric field strength decreases as the distance from the electrode increases. The "E2·S2" denotes a product of an average electric field strength E2 in a dissociation area A2 and a cross section S2 of the dissociation area A2 (cross section of a plane including a straight line connecting the point of the electrode to the charge-target object so that the distance between the point of the electrode and the charge-target object becomes a shortest distance). The "E1·S1" denotes a product of an average electric field strength E1 in the ionization area A1 and a cross section S1 of the ionization area A1 (cross section of the plane including the straight line connecting the point of the electrode to the charge target object so that the distance between the point of the electrode and the charge-target object becomes a shortest distance). Such an evaluation reveals that the smaller the ratio (E2·S2/E1·S1) is, the lesser an amount of the dissociating oxygen molecules becomes, as compared to an amount of the ionizing oxygen molecules. That is to say, the smaller the ratio is, the lesser the amount of ozone is generated, as compared to the amount of ions generated. It follows that under the condition in which the same amount of ions is generated, the amount of ozone generated decreases, as the ratio becomes smaller. It also follows that it is possible to generate more ions under the same amount of ozone generated, thereby allowing an improvement in electric charging performance.

The following description explains a simulation result for checking a relationship between respective shape of electrodes and the aforementioned ratio.

In the simulation, the following three types of electrodes were used. The distance between the tip of the electrode and the charge-target object was 10 mm.

Example 1

A needle electrode made of stainless steel, which has a cylindrical section having a diameter of 1 mm and a length of 10 mm, and a conical tip section having a length of 2 mm and a curvature radius of 5 μm.

Example 2

A needle electrode made of stainless steel, which has a cylindrical section having a diameter of 1 mm and a length of 10 mm, and a conical tip section having a length of 2 mm and a curvature radius of 50 μm.

Comparative Example 3

A sawtooth electrode made of stainless steel, in which a saw blade constituting a sawtooth has a root section whose width is 60 μm, a length of 2 mm, and a thickness of 200 μm, and is shaped so as to be pointed towards a tip having a curvature radius of 10 μm.

The following simulation tools are adopted: (i) "Femap" manufactured by Numerical Simulation Tech Co., Ltd. used as a Pre/Post software (software for carrying out (a) preliminary processes such as creating preparing analysis models, preparing mesh, and setting boundary conditions and (b) after-processes such as arrangement and analyses of analysis results); and (ii) "VOLT" manufactured by PHOTON Co., Ltd. used as an electric field analysis software.

In the ionization area A1 and the dissociation area A2, the electric field strength varies from location to location (the electric field strength is distributed so that the electric field strength is stronger as the location is closer to the needle electrode 21, and the electric field strength is weaker as the location is farther away from the needle electrode 21). In the present embodiment, the condition of the needle electrode 21 is specified by using the average electric field strength E1 in the ionization area A1 and the average electric field strength E2 in the dissociation area A2.

More specifically, an area which includes the space in contact with the needle electrode 21 and the charge-target object 1 (plane area which includes a straight line connecting the needle electrode 21 and the charge-target object 1 so that the distance between the point of the needle electrode 21 and the charge-target object 1 becomes a shortest distance (two-dimensional area)) is divided into a plurality of microscopic areas (mesh). An electric field strength which each microscopic area has when a voltage is applied between the needle electrodes 21 and the charge-target object 1 is calculated. This specifies an ionization area A1 and a dissociation area A2. An average electric field strength E1 is calculated by: (i) multiplying an electric field strength of each microscopic area included in the ionization area A1 by cross section of a respective one of the microscopic areas; (ii) adding multiplied results of each of the microscopic areas included in the ionization area A1; and (iii) dividing the multiplied results thus added by cross section S1 of the ionization area A1. That is to say, the average electric field strength E1 of the ionization area A1 is expressed as in the following formula:

$$E1 = \sum_{i=1}^{n} (\Delta E1i \cdot \Delta S1i)/S1$$

where n denotes the number of microscopic areas included in the ionization area A1; ΔA1*i* denotes the microscopic area included in the ionization area A1 (i indicates an integer not less than 1 but not more than n); ΔE1*i* denotes the electric field strength for each of the microscopic areas; and ΔS1*i* denotes the cross section of each of the microscopic areas.

Similarly, the average electric field strength E2 is calculated by: (i) multiplying an electric field strength of each microscopic area included in the dissociation area A2 by cross section of a respective one of the microscopic areas; (ii) adding multiplied result of each of the microscopic areas included in the dissociation area A2; and (iii) dividing the multiplied results thus added by cross section S2 of the dissociation area A2. The average electric field strength E2 of the dissociation area A2 is expressed as in the following formula:

$$E2 = \sum_{i=1}^{m} (\Delta E2i \cdot \Delta S2i)/S2$$

where m denotes the number of microscopic areas included in the dissociation area A2; ΔA2*i* denotes the microscopic area included in the dissociation area A2 (i indicates an integer not less than 1, not more than m); ΔE2*i* denotes the electric field strength for each of the microscopic areas; and ΔS2*i* denotes the cross section of each of the microscopic areas.

An average electric field strength E1 may be calculated by: (i) partitioning electric field strengths of the ionization areas A1 into a plurality of sections which vary in accordance with their electric field strengths (for example, every 0.5 MV/m); (ii) calculating a section average value, which is an average value of the electric field strengths in each of the sections; (iii) finding cross section of each of the sections by adding each cross-section of the microscopic areas belonged to the each the sections; (iv) multiplying each of the section average values of the electric field strengths by respective one of cross section of the sections; (v) adding all of multiplied results; and (vi) dividing the multiplied results thus added by cross section S1 of the ionization area A1. Similarly, an average electric field strength E2 may be calculated by: (i) partitioning electric field strengths of the dissociation areas A2 into a plurality of sections which vary in accordance their electric field strengths (for example, every 0.5 MV/m); (ii) calculating a section average value, which is an average value of the electric field strengths in each of the sections; (iii) finding cross section of each of the sections by adding each cross section of the microscopic areas belonged to the each sections; (iv) multiplying each of the section average values of the electric field strengths by respective one of cross section of the sections; (v) adding all of multiplied results; and (vi) dividing the multiplied results thus added by cross section S2 of the dissociation area A2.

Figure 7:
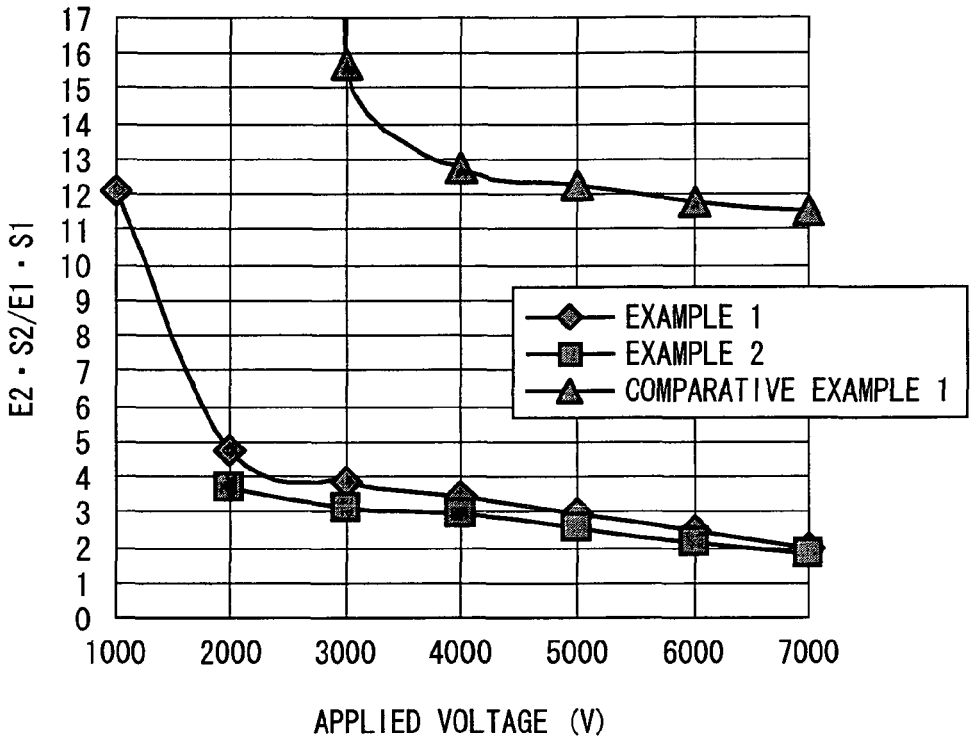
FIG. 7 is a graph illustrating a relationship between an applied voltage and a ratio of (a) a product of an average electric field strength in a dissociation area and a cross section of the dissociation area to (b) a product of an average electric field strength in an ionization field and a cross section of the ionization area, in an electric charging device in accordance with one embodiment of the technology disclosed herein.

FIG. 7 is a graph illustrating a result of each of the above simulations. As illustrated in the graph, when using the electrodes of Example 1 and Example 2, it was possible to suppress the above ratio falling in a range of not less than 2 to not more than 5, over a broad range of a potential difference between the electrode and the charge-target object, from −1.0 kV to −7.0 kV (a voltage applied between the electrode and the charge-target object is not less than 1.0 kV but not more than 7.0 kV). It was possible to suppress the above ratio more when the needle electrode of Example 1, having a smaller curvature radius of a needlepoint than Example 2, is used than when the needle electrode of Example 2. In contrast, the above ratio was great when the sawtooth electrode of Comparative Example 1 was used. Even for a potential difference of −7.0 kV (applied voltage of 7.0 kV) applied between the electrode and the charge-target object, the ratio became a value of not less than 11. As is clear from this, the amount of ozone generated can be suppressed more when the electrodes of Example 1 and Example 2 are used than when the electrode of Comparative Example 1 is used.

Figure 8:
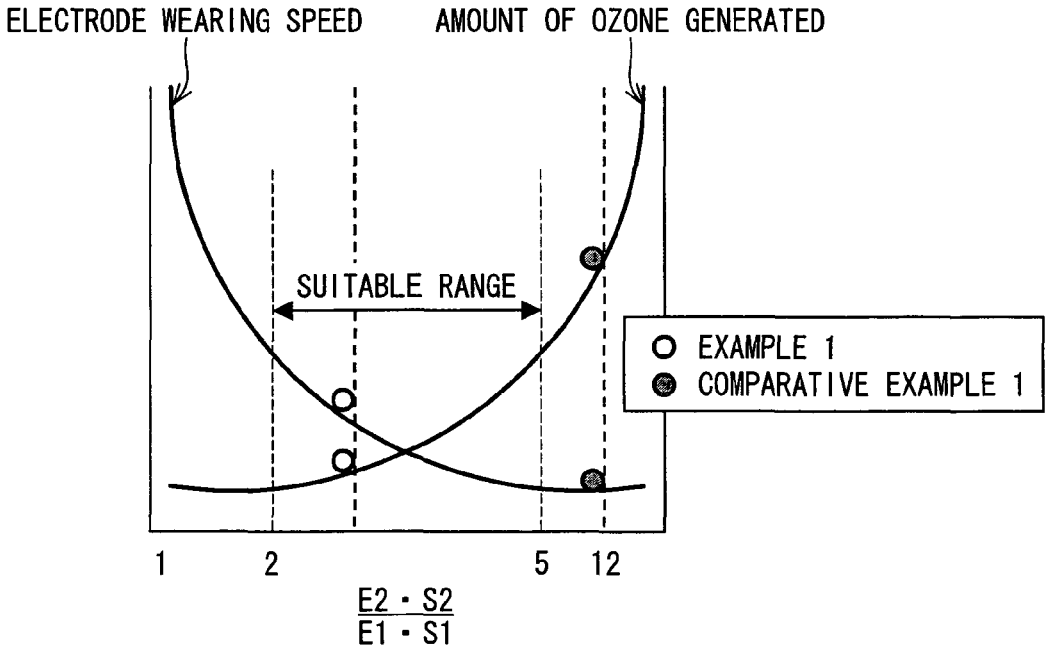
FIG. 8 is a graph illustrating (i) relationship between an amount of ozone generated and a ratio of (a) a product of an average electric field strength in a dissociation area and a cross section of the dissociation area to (b) a product of an average electric field strength of an ionization area and a cross section of the ionization area, and (ii) a relationship between the above ratio and an electrode wearing speed, in an electric charging device in accordance with one embodiment of the technology disclosed herein.
Figure 9:
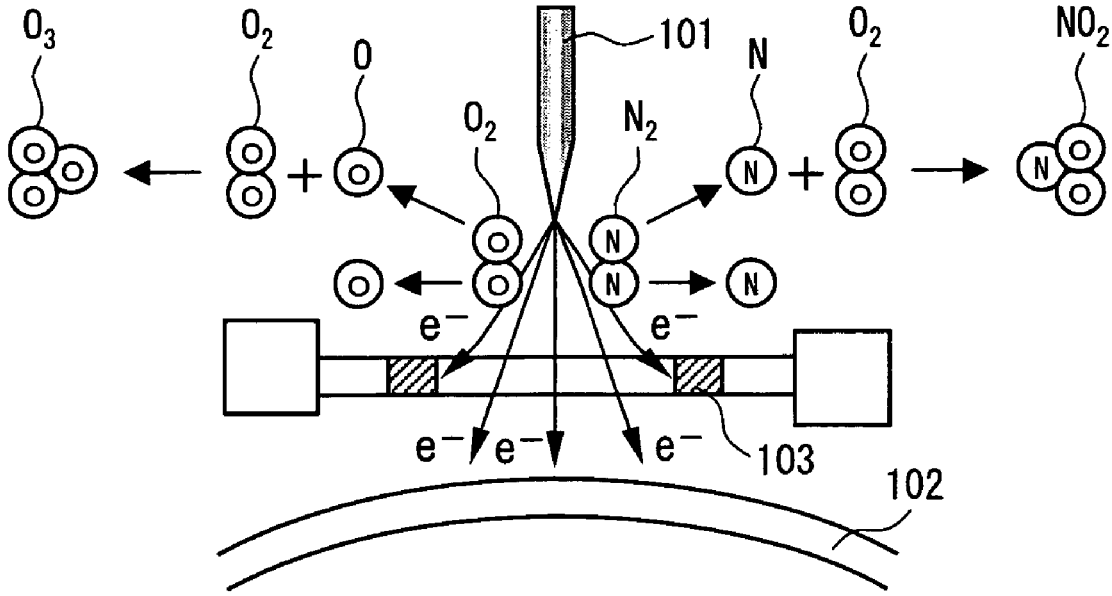
FIG. 9 is an explanatory drawing schematically illustrating an electric charging mechanism of a conventional electric charging device of a corona discharge type.

The ratio decreases as the voltage applied between the electrode and the charge-target object (absolute value of potential difference between the electrode and the charge-target object) increases. The smaller the ratio is, the smaller a ratio of an amount of ozone generated with respect to an amount of ions generated. However, if an overhigh voltage is applied between the electrode and the charge-target object, then a ratio of the amount of ozone generated to the amount of ions generated is reduced. However, the wearing of the electrode progresses. This causes durable years of the electrode to shorten. This gives rise to the problem that ions cannot be stably generated due to the ageing (charging cannot be performed). FIG. 8 is a graph illustrating a relationship between the above ratio and the amount of ozone generated, and a relationship between the above ratio and the electrode wearing speed.

Therefore, it is preferable to set a shape of the electrode and a voltage to be applied so that the above ratio falls within a range in which: (a) an amount of ions can be generated which causes the photoreceptor to be charged and to have a predetermined potential; (b) the amount of ozone generated can be reduced within a predetermined amount; and (c) the wearing speed of the electrode is below a predetermined speed.

More specifically, it is preferable that an electrode having a shape of needle be used. This is because a needle electrode has a smaller E2·S2/E1·S1 ratio than a sawtooth electrode, so as to reduce the amount of ozone generated. It is preferable that a needle electrode with a smaller curvature radius of a needlepoint be adopted. This is because the smaller the curvature radius of the needlepoint, the smaller the E2·S2/E1·S1 ratio is so that the amount of ozone generated can be reduced. Note however that a wearing resistance deteriorates if the electrode has a too small needlepoint curvature radius. Therefore, it is preferable for a needle electrode to have a curvature radius falling in a range which allows an appropriate wearing resistance. For example, it is preferable that, when a needle electrode made of stainless steel is adopted, the needle electrode have a needlepoint curvature radius falling in a range of not less than 5 μm to not more than 50 μm.

When the voltage to be applied is less than 2.0 kV, the E2·S2/E1·S1 ratio becomes extremely great (5 or more), as illustrated in FIG. 7. When a voltage to be applied is less than 2.0 kV, a sufficient amount of ions are not generated which causes the photoreceptor to be charged and to have a predetermined potential (a potential of −600 V in the present embodiment). As such, the photoreceptor is charged so as to have the predetermined potential by applying a voltage of not less than 2.0 kV. Therefore, it is preferable to set a voltage to be applied so that the E2·S2/E1·S1 ratio is not more than 5.

As illustrated in FIG. 7, the E2·S2/E1·S1 ratio can be decreased by increasing the voltage to be applied. However, when the E2·S2/E1·S1 ratio is not more than 2, the E2·S2/E1·S1 ratio can hardly be further decreased even if a voltage to be applied is further increased. That is to say, when a voltage of more than 7.0 kV is applied, a reduction in amount of the E2·S2/E1·S1 ratio with respect to an increase in voltage becomes small. As such, the E2·S2/E1·S1 ratio becomes hardly further decreased even if a voltage to be applied is increased. In addition, the wearing of the electrode intensifies when a voltage of more than 7.0 kV is applied (the wearing speed of the electrode remarkably increases). Therefore, it is preferable to set a voltage to be applied so that an E2·S2/E1·S1 ratio is not less than 2.

Thus, in the present embodiment, the tip shape of an electrode (curvature radius) and a voltage to be applied to the electrode are set so that the following inequality is satisfied: $2 \leqq (E2 \cdot S2)/(E1 \cdot S1) \leqq 5$.

This allows (i) a reduction in size of a dissociation area with respect to an ionization area, as compared to a case where an (E2·S2)/(E1·S1) ratio is more than 5 and (ii) a reduction in ratio of an amount of ozone generated, nitrogen oxide generated and the like with respect to an amount of ions generated. Therefore, it is possible to (i) efficiently generate an amount of ions required to uniformly charge a charge-target object and (ii) reduce an amount of ozone generated, nitrogen oxide generated and the like. It is also possible to slow down a wearing speed (deterioration speed) of a charging electrode, as compared to when a (E2·S2)/(E1·S1) ratio is less than 2. Therefore, it is possible to stably and continuously carry out electric charging over the long term.

According to the present embodiment, ions are generated around the needle electrodes 21 by applying a voltage between the needle electrodes 21 and the charge-target object 1 so that a charge-target object is charged by the ions thus generated. Thus, it is possible to greatly reduce an amount of ozone generated, nitrogen oxide generated and the like, as compared to a case where a charge-target object is charged by causing electric discharge to be generated between the needle electrodes 21 and the charge-target object 1. In order for electric discharge not to be generated, the following relationship is to be satisfied: $V/g<3.0$, where V (kV) denotes a voltage applied between the needle electrodes 21 and the charge-target object 1, and g (mm) denotes a distance (gap) between the needle electrodes 21 and the charge-target object 1. This allows an occurrence prevention of electric discharge between the needle electrodes 21 and the charge-target object 1. The voltage V and a gap g may be set so that the following relationship is satisfied: $V<312+6200\ g$, where g (mm) denotes a distance (gap) between the needle electrodes 21 and the charge-target object 1. This allows the voltage V to be smaller than a voltage corresponding to a discharge initiation condition of the Paschen Law. As such, it is possible to avoid that electric discharge generates between the needle electrodes 21 and the charge-target object 1.

The present embodiment explains a case where a needle electrode is used as the charging electrode. However, the shape of the charging electrode is not limited to the needle electrode, provided that an (E2·S2)/(E1·S1) ratio falls within the range specified above. In other words, in the present embodiment, the conditions of a shape of the electrode and a voltage to be applied to the electrode are defined in accordance with a range of the (E2·S2)/(E1·S1) ratio. This allows, even when a differently shaped electrode is used, conditions to be appropriately defined, which cause a sufficient amount of ions to be generated while suppressing an amount of ozone generated and which cause stable electric charging to be carried out over the long term.

The present embodiment explains an arrangement where a plurality of needle electrodes 21 are provided. However, the technology disclosed-herein is not limited to this, and may be arranged so that a single needle electrode 21 is provided.

Although the pitch p of the needle electrodes 21 is set to 10 mm in the present embodiment, it is not limited to this. Note however that, if a pitch p between the needle electrodes 21 is greater than 25 mm, ions generated around the pointed section of each of the needle electrodes 21 readily disperse into the air. This causes inefficient charging of the photoreceptor. If a pitch between the needle electrodes 21 is smaller than 4 mm, electric discharge readily occurs between the electrodes. Therefore, the pitch p preferably falls in a range of not less than 4 mm to not more than 25 mm.

The present embodiment uses, as the needle electrode 21, an electrode having a shape in which an edge part having a pointed section is axisymmetric with respect to an axis which passes through the pointed section. This allows an axisymmetric electric field to be generated around the pointed section, thereby ensuring a substantially uniform distribution, on a plane perpendicular to the axis, of the amount of ions generated. Therefore, it is possible to charge substantially in uniform a part of the photoreceptor which faces the pointed section. It is also possible to easily define an arrangement (a pitch) of the needle electrodes 21, which arrangement causes a charge-target object to be uniformly charged.

The present embodiment evaluates an electric field strength generated around the electrode by using a two-dimensional model. Specifically, conditions of a shape of the electrode and a voltage to be applied to the electrode are defined by using cross section S1 of an ionization area A1 and cross section S2 of a dissociation area A2. As such, the most appropriate conditions of the shape of the electrode and the voltage to be applied to the electrode are easily and appropriately evaluated, by using the two-dimensional model. However, the present embodiment is not limited to this, and a three-dimensional model may be used for an evaluation of the electric field strength. In such case, a range of a value of a ratio "(E2'×V2)/(E1'×V1)" is to be set so that the ratio falls within a range in which: (a) an amount of ions can be generated which causes the photoreceptor to be charged and to have a predetermined potential; (b) the amount of ozone generated can be reduced within a predetermined amount; and (c) the wearing speed of the electrode is below a predetermined speed. The ratio "(E2'×V2)/(E1'×V1)" denotes, in other words, a ratio of a product of a volume V2 of a three-dimensional dissociation area A2' and an average electric field strength E2' of the dissociation area A2', to a product of a volume V1 of a three-dimensional ionization area A1' and an electric field strength E1' of the ionization area A1'.

The present embodiment explains a case where a photoreceptor drum 1 is provided separately from the electric charging device 10. However, it is possible to consider an arrangement in which a photoreceptor drum 1 and an electric charging device 10 are provided together as an electric charging device in accordance with one embodiment of the technology disclosed herein.

The present embodiment deals with a case of an electric charging device for charging a photoreceptor drum 1 provided in an electrophotographic image forming apparatus. However, a charge-target object is not limited to the photoreceptor drum 1. For example, the present embodiment is applicable to a transfer device (electric charging device), a paper removing device (electric charging device), an electric charging device (pretransfer electric charging device), and/or other devices. The transfer device electrostatically transfers a toner image formed on a photoreceptor or the like to a recording paper or the like. The paper removing device peels off a recording paper or the like which is in electrostatically contact with the photoreceptor or the like. The electric charging device charges a toner image on the photoreceptor or a toner image transferred to an intermediate transfer member.

Figure 10:
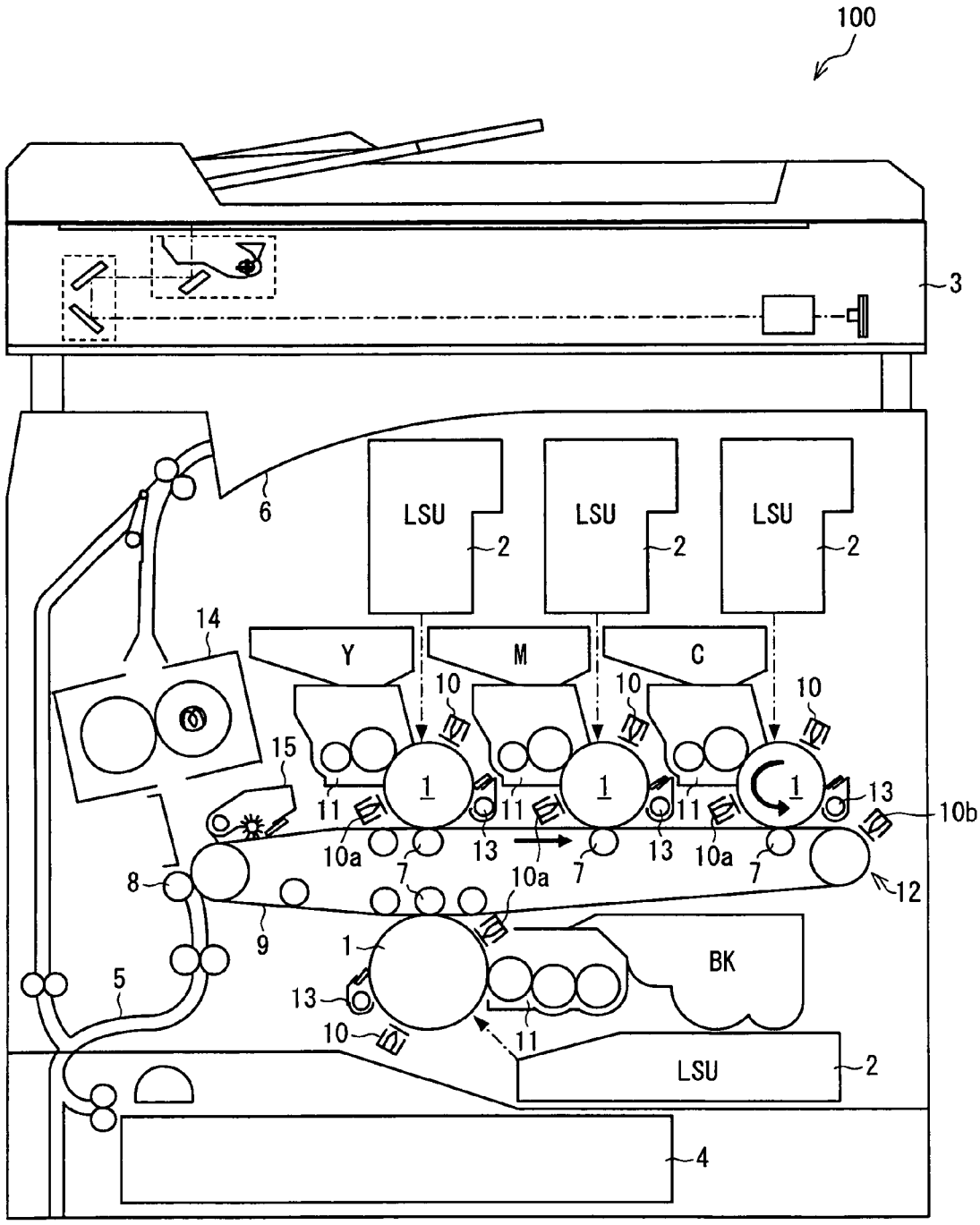
FIG. 10 is a cross sectional view illustrating a modification of an image forming apparatus in accordance with one embodiment of the technology disclosed herein.

FIG. 10 is a cross sectional view illustrating an example arrangement in which, in addition to the arrangement of the copying machine (image forming apparatus) 100 as shown in FIG. 2, an electric charging device (pretransfer electric charging device) 10*a* and an electric charging device (pretransfer electric charging device) 10*b* are provided. The electric charging device 10*a* charges a toner image on the photoreceptor which has not been subjected to transfer to the intermediate transfer belt 9. The electric charging device 10*b* charges the toner image transferred on the intermediate transfer belt 9. An electric charging device similar to the electric charging device 10 may be used as the electric charging devices 10*a* and 10*b*. By thus causing the electric charging device 10*a* to charge the toner image on the photoreceptor before the toner image is transferred to the intermediate transfer belt, the charged amount of the toner image is made uniform before the toner image is transferred to the intermediate transfer belt 9, even if the charged amount of the toner image formed on the photoreceptor is not uniform. This allows the toner image to be stably transferred to the intermediate transfer belt 9. The electric charging device 10*b* charges the toner image on the intermediate transfer belt 9 before the toner image is transferred to the recording material. This prevents the toner on the intermediate transfer belt 9 from dropping and scattering due to a decrease in toner charged amount of the toner image.

Charge-target objects are not limited to members, toner images and the like which are provided in the image forming apparatus. The present embodiment is applicable to an arrangement in which a charge-target object is charged in non-contact manner.

An electric charging device of the technology disclosed herein is an electric charging device including at least one charging electrode to be provided in non-contact with a charge-target object and voltage application means for applying a voltage to the at least one charging electrode, the electric charging device causing the charge-target object to be charged by ions generated when a voltage is applied to the at least one charging electrode, the at least one charging electrode having a pointed section provided so as to face the charge-target object; and the voltage to be applied to the electric charging device is set so as to satisfy $2 \leqq (E2 \cdot S2)/(E1 \cdot S1) \leqq 5$, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to the at least one charging electrode is not less than the ionization occurrence threshold value TH1; a dissociation area A2 indicates an area in which an electric field strength generated around the pointed section while a voltage is applied to the at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section of the ionization area A1 on a plane which includes a straight line connecting the at least one charging electrode and the charge-target object so that a distance between the at least one charging electrode and the charge-target object becomes a shortest distance; and S2 indicates cross section of the dissociation area A2 of the plane.

A charging method of the technology disclosed herein is a method for causing a charge-target object to be charged by ions generated when a voltage is applied to at least one charging electrode, the method comprising the steps of: preparing and using as the at least one charging electrode an electrode having a pointed section provided so as to face the charge-target object; setting the voltage to applied to the at least one charging electrode so that $2 \leqq (E2 \cdot S2)/(E1 \cdot S1) \leqq 5$ is satisfied, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to the at least one charging electrode is not less than the ionization occurrence threshold value TH1; a dissociation area A2 indicates an area in which an electric field strength generated around the pointed section while a voltage is applied to the at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section of the ionization area A1 on a plane which includes a straight line connecting the at least one charging electrode and the charge-target object so that a distance between the at least one charging electrode and the charge-target object becomes a shortest distance; and S2 indicates cross section of the dissociation area A2 of the plane.

A manufacturing method for the electric charging device of the technology disclosed herein is a method for manufacturing an electric charging device which includes at least one charging electrode to be provided in non-contact with a charge-target object; and voltage application means for applying a voltage to the at least one charging electrode, the electric charging device causing the charge-target object to be charged by ions generated when a voltage is applied to the at least one charging electrode, the method including the steps of: providing the charging electrode having a pointed section so as to face the charge-target object; and setting the voltage to be applied to the at least one charging electrode so that $2 \leqq (E2 \cdot S2)/(E1 \cdot S1) \leqq 5$ is satisfied, where TH1 indicates an ionization occurrence threshold value which is a minimum value of an electric field strength causing oxygen molecules in an atmosphere to be ionized; TH2 indicates a dissociation occurrence threshold value which is a minimum value of an electric field strength causing oxygen molecules in the atmosphere to be dissociated; an ionization area A1 indicates an area in which an electric field strength generated around the pointed section while a voltage is applied to the at least one charging electrode is not less than the ionization occurrence threshold value TH1; a dissociation area A2 indicates an area in which an electric field strength generated around the pointed section while a voltage is applied to the at least one charging electrode is not less than the dissociation occurrence threshold value TH2 and less than the ionization occurrence threshold value TH1; E1 indicates an average electric field strength in the ionization area A1; E2 indicates an average electric field strength in the dissociation area A2; S1 indicates cross section of the ionization area A1 on a plane which includes a straight line connecting the at least one charging electrode and the charge-target object so that a distance between the at least one charging electrode and the charge-target object becomes a shortest distance; and S2 indicates cross section of the dissociation area A2 of the plane.

With each of the arrangements, the charge-target object is charged by the ions. Therefore, it is possible to charge a charge-target object more uniformly, as compared to a case where a charge-target object is charged by electric discharge. Use of a charging electrode having a pointed section allows a decrease in (E2·S2)/(E1·S1) ratio. An adjustment of a voltage to be applied to the charging electrode enables the inequality $2 \leqq (E2 \cdot S2)/(E1 \cdot S1) \leqq 5$ to be satisfied. The dissociation area with respect to the ionization area can be made to be smaller by setting the (E2·S2)/(E1·S1) ratio to not more than 5, as compared to a case where the (E2·S2)/(E1·S1) ratio is greater than 5. It is thus possible to reduce the ratio of the generated amount of ozone, nitrogen oxide and the like with respect to the generated amount of ions. As such, it is possible to efficiently generate an amount of ions required to uniformly charge the charge-target object, while reducing the generated amount of ozone, nitrogen oxide and the like being generated. When setting the (E2·S2)/(E1·S1) ratio to not less than 2, it is avoided that the voltage to be applied to the charging electrode becomes too great. This suppresses an increase in wearing speed (deterioration speed) of the charging electrode. Therefore, it is possible to stably carry out electric charging over the long term.

The at least one charging electrode may have a curvature radius falling in a range of not less than 5 μm to not more than 50 μm.

With the arrangement, it is possible to generate an area of the tip of the electrode in which a strong electric field is generated when the curvature radius of the pointed section of the charging electrode is not more than 50 μm. This allows a reduction in ratio of the amount of ozone generated with respect to the amount of ions generated, by relatively reducing the range of the dissociation area with respect to the ionization area. When the curvature radius of a tip of the charging electrode is set to not less than 5 μm, the decrease in wearing resistance is more suppressed in the charging electrode, as compared to a case where the curvature radius of the pointed section is less than 5 μm.

The at least one charging electrode may be made of stainless steel.

With the arrangement, the wearing resistance of the electrode is improved more because the charging electrode is made of stainless steel, as compared to the case where other material, such as tungsten, is used as the material of the electrode. The stainless steel has high durability of corrosion such as rust due to moisture in the atmosphere and the like. Therefore, it is possible to make the durable period of the electrode longer than the case where other material such as tungsten is used as the material. Electric resistance is reduced due to the use of the stainless steel as the material for the charging electrode. This causes a reduction in electric power consumption. The charging electrode can also be cheaply manufactured, and therefore can reduce manufacturing costs for the electric charging device, as compared to a case where other material such as tungsten is used.

The electric charging device of the technology disclosed herein may be arranged such that the voltage to be applied to the at least one charging electrode is in a range of not less than 2.0 kV to not more than 7.0 kV.

The amount of ions generated tends to decrease when the voltage of less than 2.0 kV is applied to the electrode. In contrast, with the arrangement, the amount of ions generated is increased because the voltage of not less than 2.0 kV is applied to the electrode. This allows a charge-target object to be appropriately charged. The progression speed of the wearing of the electrode increases when a voltage of higher than 7.0 kV is applied. In contrast, with the arrangement, it is possible to suppress an increase in progression speed of the wearing of the electrode because a voltage of not more than 7.0 kV is applied to the electrode.

The electric charging device of the technology disclosed herein may be arranged such that the at least one charging electrode includes a plurality of needle electrodes; a pointed section of each of the needle electrodes is provided so as to face the charge-target object; and $2 \leqq (E2 \cdot S2)/(E1 \cdot S1) \leqq 5$ is satisfied in an area around the pointed section of each of the needle electrodes.

With the arrangement, ions are generated from each of the needle electrodes. This causes an increase in amount of ions generated. On this account, it is possible to charge a charge-target object more suitably. The generated amount of ozone, nitrogen oxide and the like are reduced because $2 \leqq (E2 \cdot S2)/(E1 \cdot S1) \leqq 5$ is satisfied in an area around the pointed section of each of the needle electrodes. Since the increase in wearing speed (deterioration speed) of the charging electrode is suppressed, it is also possible to continuously and stably carry out electric charging over the long term.

The electric charging device of the technology disclosed herein may be arranged such that the needle electrodes are provided at a pitch falling in a range of not less than 4 mm to not more than 25 mm.

When the needle electrodes are arranged at a pitch of more than 25 mm, the ions generated around the pointed section of each of the needle-shaped electrodes readily disperse into the air. This makes it difficult to efficiently charge the charge-target object. When the needle electrodes are arranged at a pitch of smaller than 4 mm, electric discharge readily occurs between the electrodes. In contrast, with the arrangement, the needle electrodes are arranged at a pitch falling in a range of not less than 4 mm to not more than 25 mm. As such, it is possible to prevent the occurrence of electric discharge, while efficiently charging the charge-target object.

The electric charging device may be arranged such that an edge section on a side including the pointed section of each of the needle electrodes is in an axisymmetric shape with respect to an axis passing through the pointed section.

With the arrangement, since an axisymmetric electric field is formed around the pointed section, it is possible to ensure a substantially uniform distribution, on a plane perpendicular to the axis, of the amount of ions generated. Thus, a part of the charge-target object which faces the pointed section is charged substantially uniform. For the electric charging device including a plurality of needle-shaped electrodes, it is possible to easily define an arrangement of the needle-shaped electrodes, which arrangement causes a charge-target object to be uniformly charged the charge-target object.

The image forming apparatus of the technology disclosed herein carries out an electrophotographic image formation, and incorporates any one of the aforementioned electric charging devices.

With the arrangement, it is possible to carry out charging which reduces products such as ozone and nitrogen oxide, and which stably continues for a long stretch of time.

For example, the image forming apparatus of the technology disclosed herein may be arranged including an image bearing member; a main electric charging device for charging a surface of the image bearing member, the electric charging device serving as the main electric charging device; an exposing device for exposing the surface of the image bearing member charged by the main electric charging device so that an electrostatic latent image is formed; a developing device for developing the electrostatic latent image with toner so as to form a toner image; and a transfer device for transferring the toner image onto a transfer-target object.

With the arrangement, it is possible to stably charge the image bearing member, serving as a charge-target object, for a long period of time. The arrangement also allows a reduction in amount of ozone, nitrogen oxide and the like which are generated during the charging.

The image forming apparatus of the technology disclosed herein may be arranged such that the image forming apparatus includes: a plurality of image forming units each including the image bearing member, the main electric charging device, the exposing device, the developing device, and the transfer device, images having different colors are transferred and overlapped on the transfer-target object by the plurality of image forming units, respectively, so that a multicolor image is formed.

With the arrangement, the image bearing member, serving as a charge-target object in each image forming unit, can be stably charged for a long period of time. The arrangement also allows a reduction in amount of ozone, nitrogen oxide and the like which are generated in each of the image forming units during the charging. As such, it is possible for the entire image forming apparatus to greatly reduce the generated amount of ozone, nitrogen oxide and the like. Since many electric charging devices are provided in the image forming apparatus, it is possible to reduce the manufacturing cost of the electric charging devices due to mass production effect.

The image forming apparatus of the technology disclosed herein may be arranged such that the image forming apparatus includes an image bearing member; a main electric charging device for charging a surface of the image bearing member; an exposing device for exposing the surface of the image bearing member charged by the main electric charging device so that an electrostatic latent image is formed; a developing device for developing the electrostatic latent image with toner so as to form a toner image; and a transfer device for transferring the toner image to an intermediate transfer member which serves as a transfer-target object, the intermediate transfer member feeding the toner image thus transferred to a section facing a recording material so that the toner image thus fed is transferred to the recording material, the toner image transferred on the intermediate transfer member being charged by any one of the aforementioned electric charging devices.

With the arrangement, it is possible to prevent the toner from dropping and scattering due to the decrease in charged amount of the toner transferred on the intermediate transfer member. It is also possible to stably charge the toner on the intermediate transfer member, which serves as the charge-target object, for a long period of time. In addition, the amount of ozone, nitrogen oxide and the like which are generated is reduced while charging.

The image forming apparatus may be arranged including an image bearing member; a main electric charging device for charging a surface of the image bearing member; an exposing device for exposing the surface of the image bearing member charged by the main electric charging device so that an electrostatic latent image is formed; a developing device for developing the electrostatic latent image with toner so as to form a toner image; a transfer device for transferring the toner image onto a transfer-target object; and a pretransfer electric charging device for charging the toner image on the image bearing member before the toner image is transferred to the transfer-target object, any one of the aforementioned electric charging device being incorporated in the image forming apparatus serving as the pretransfer electric charging device.

With the arrangement, it is possible to make the charged amount of the toner image in uniform before the toner image is transferred to the transfer-target object (the object to be transferred), even if the charged amount of the toner image formed on the image bearing member is not in uniform. Thus, the toner image is stably transferred onto the transfer body. The toner on the image bearing member, which serves as the charge-target object, is stably charged for a long period of time. In addition, it is possible to reduce the amount of ozone, nitrogen oxide and the like which are generated during the charging.

The image forming apparatus may be arranged such that the image forming apparatus includes an image bearing member; a main electric charging device for charging a surface of the image bearing member; an exposing device for exposing the surface of the image bearing member charged by the main electric charging device so that an electrostatic latent image is formed; a developing device for developing the electrostatic latent image with toner so as to form a toner image; and a transfer device for transferring the toner image to an intermediate transfer member which serves as a transfer-target object, the intermediate transfer member feeding the toner image thus transferred to a section facing a recording material so that the toner image thus fed is transferred to the recording material, the intermediate transfer member being charged by any one of the aforementioned electric charging devices. The charging potential of the intermediate transfer member is set similarly to an electric charging device which uses a conventional intermediate transfer belt, so that the toner image on the image bearing member is appropriately transferred on the intermediate transfer member, and the toner image transferred from the image bearing member is appropriately fed to the section facing the recording material.

With the arrangement, it is possible to stably charge the surface of the intermediate transfer member, which serves as the charge-target object, for a long period of time. In addition, it is possible to reduce the generated amount of ozone, nitrogen oxide and the like during the charging of the intermediate transfer belt.

The embodiments and concrete examples of implementation discussed in the foregoing detailed explanation serve solely to illustrate the technical details of the technology disclosed herein, which should not be narrowly interpreted within the limits of such embodiments and concrete examples, but rather may be applied in many variations within the spirit of the present invention, provided such variations do not exceed the scope of the patent claims set forth below.

What is claimed is:

1. An electric charging device comprising:

at least one charging electrode to be provided in non-contact with a charge-target object; and voltage application means for applying a voltage to said at least one charging electrode, the electric charging device causing the charge-target object to be charged by ions generated when a voltage is applied to said at least one charging electrode, said at least one charging electrode having a pointed section provided so as to face the charge-target object; and the voltage to be applied to said at least one charging electrode is set so as to satisfy $2 \leqq (E2 \cdot S2)/(E1 \cdot S1) \leqq 5$, where TH1 indicates an ionization occurrence threshold value in MV/m which is a minimum value of an electric field strength causing oxygen molecules in an atmosphere to be ionized; TH2 indicates a dissociation occurrence threshold value in MV/m which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in MV/m in the ionization area A1; E2 indicates an average electric field strength in MV/m in the dissociation area A2; S1 in $m^2$ indicates cross section of the ionization area A1 on a plane which includes a straight line connecting said at least one charging electrode and the charge-target object so that a distance between said at least one charging electrode and the charge-target object becomes a shortest distance; and S2 in $m^2$ indicates cross section of the dissociation area A2 of the plane.

2. The electric charging device as set forth in claim 1, wherein the pointed section of said at least one charging electrode has a curvature radius falling in a range of not less than 5 μm to not more than 50 μm.

3. The electric charging device as set forth in claim 1, wherein said at least one charging electrode is made of stainless steel.

4. The electric charging device as set forth in claim 1, wherein the voltage to be applied to said at least one charging electrode is in a range of not less than 2.0 kV to not more than 7.0 kV.

5. The electric charging device as set forth in claim 1, wherein:

said at least one charging electrode includes a plurality of needle electrodes;

a pointed section of each of the needle electrodes is provided so as to face the charge-target object; and $2 \leqq (E2 \cdot S2)/(E1 \cdot S1) \leqq 5$ is satisfied in an area around the pointed section of each of the needle electrodes.

6. The electric charging device as set forth in claim 5, wherein the needle electrodes are provided at a pitch falling in a range of not less than 4 mm to not more than 25 mm.

7. The electric charging device as set forth in claim 1, wherein an edge section on a side including the pointed section in each of the needle electrodes is in an axisymmetric shape with respect to an axis passing through the pointed section.

8. An image forming apparatus which carries out an electrophotographic image formation, said image forming apparatus comprising an electric charging device, said electric charging device including at least one charging electrode to be provided in non-contact with a charge-target object; and voltage application means for applying a voltage to said at least one charging electrode, the electric charging device causing the charge-target object to be charged by ions generated when a voltage is applied to said at least one charging electrode, said at least one charging electrode having a pointed section provided so as to face the charge-target object; and the voltage to be applied to said at least one charging electrode is set so as to satisfy $2 \leqq (E2 \cdot S2)/(E1 \cdot S1) \leqq 5$, where TH1 indicates an ionization occurrence threshold value in MV/m which is a minimum value of an electric field strength causing oxygen molecules in an atmosphere to be ionized; TH2 indicates a dissociation occurrence threshold value in MV/m which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in MV/m in the ionization area A1; E2 indicates an average electric field strength in MV/m in the dissociation area A2; S1 in $m^2$ indicates cross section of the ionization area A1 on a plane which includes a straight line connecting said at least one charging electrode and the charge-target object so that a distance between said at least one charging electrode and the charge-target object becomes a shortest distance; and S2 in $m^2$ indicates cross section of the dissociation area A2 of the plane.

9. The image forming apparatus as set forth in claim 8, further comprising:

an image bearing member;

a main electric charging device for charging a surface of the image bearing member, said electric charging device serving as the main electric charging device;

an exposing device for exposing the surface of the image bearing member charged by the main electric charging device so that an electrostatic latent image is formed;

a developing device for developing the electrostatic latent image with toner so as to form a toner image; and a transfer device for transferring the toner image onto a transfer-target object.

10. The image forming apparatus as set forth in claim 9, comprising:

a plurality of image forming units each including the image bearing member, the main electric charging device, the exposing device, the developing device, and the transfer device, images having different colors are transferred and overlapped on the transfer-target object by said plurality of image forming units, respectively, so that a multicolor image is formed.

11. The image forming apparatus as set forth in claim 8, further comprising:

an image bearing member;

a main electric charging device for charging a surface of the image bearing member;

an exposing device for exposing the surface of the image bearing member charged by the main electric charging device so that an electrostatic latent image is formed;

a developing device for developing the electrostatic latent image with toner so as to form a toner image; and a transfer device for transferring the toner image to an intermediate transfer member which serves as a transfer-target object, the intermediate transfer member feeding the toner image thus transferred to a section facing a recording material so that the toner image thus fed is transferred to the recording material, the toner image transferred on the intermediate transfer member being charged by said electric charging device.

12. The image forming apparatus as set forth in claim 8, further comprising:

an image bearing member;

a main electric charging device for charging a surface of the image bearing member;

an exposing device for exposing the surface of the image bearing member charged by the main electric charging device so that an electrostatic latent image is formed;

a developing device for developing the electrostatic latent image with toner so as to form a toner image;

a transfer device for transferring the toner image onto a transfer-target object; and a pretransfer electric charging device for charging the toner image on the image bearing member before the toner image is transferred to the transfer-target object, said electric charging device serving as the pretransfer electric charging device.

13. The image forming apparatus as set forth in claim 8, further comprising:

an image bearing member;

a main electric charging device for charging a surface of the image bearing member;

an exposing device for exposing the surface of the image bearing member charged by the main electric charging device so that an electrostatic latent image is formed;

a developing device for developing the electrostatic latent image with toner so as to form a toner image; and a transfer device for transferring the toner image to an intermediate transfer member which serves as a transfer-target object, the intermediate transfer member feeding the toner image thus transferred to a section facing a recording material so that the toner image thus fed is transferred to the recording material, the intermediate transfer member being charged by said electric charging device.

14. A charging method for causing a charge-target object to be charged by ions generated when a voltage is applied to at least one charging electrode, said method comprising the steps of:

preparing and using as said at least one charging electrode an electrode having a pointed section provided so as to face the charge-target object; and setting the voltage to applied to said at least one charging electrode so that $2 \leqq (E2 \cdot S2)/(E1 \cdot S1) \leqq 5$ is satisfied, where TH1 indicates an ionization occurrence threshold value in MV/m which is a minimum value of an electric field strength causing oxygen molecules in an atmosphere to be ionized; TH2 indicates a dissociation occurrence threshold value in MV/m which is a minimum value of an electric field strength causing oxygen molecules in the atmosphere to be dissociated; an ionization area A1 indicates an area in which an electric field strength generated around the pointed section while a voltage is applied to said at least one charging electrode is not less than the ionization occurrence threshold value TH1; a dissociation area A2 indicates an area in which an electric field strength generated around the pointed section while a voltage is applied to said at least one charging electrode is not less than the dissociation occurrence threshold value TH2 and less than the ionization occurrence threshold value TH1; E1 indicates an average electric field strength in MV/m in the ionization area A1; E2 indicates an average electric field strength in MV/m in the dissociation area A2; S1 in $m^2$ indicates cross section of the ionization area A1 on a plane which includes a straight line connecting said at least one charging electrode and the charge-target object so that a distance between said at least one charging electrode and the charge-target object becomes a shortest distance; and S2 in $m^2$ indicates cross section of the dissociation area A2 of the plane.

* * * * *